US005158524A

United States Patent [19]

Muto et al.

[11] Patent Number: 5,158,524

[45] Date of Patent: Oct. 27, 1992

[54] APPARATUS FOR RESTRAINING A PAPER WEB TO BE SUBJECTED TO CHOPPER-FOLD IN ROTARY PRINTING PRESS

[75] Inventors: Minoru Muto; Masanori Tabata, both of Kawasaki, Japan

[73] Assignee: Kabushiki Kaisha Tokyo Kikai Seisakusho, Tokyo, Japan

[21] Appl. No.: 729,290

[22] Filed: Jul. 12, 1991

[30] Foreign Application Priority Data

Jul. 13, 1990 [JP] Japan ..... 2-184099

[51] Int. Cl.[5] ..... B65H 45/18; B41F 13/58

[52] U.S. Cl. ..... 493/417; 493/444

[58] Field of Search ..... 493/417, 435, 444, 445

[56] References Cited

U.S. PATENT DOCUMENTS

| | | | |
|---|---|---|---|
| 4,545,782 | 10/1985 | Niemiro et al. | 493/444 |
| 4,643,705 | 2/1987 | Bober | 493/444 |
| 4,995,858 | 2/1991 | Stäb | 493/445 |

FOREIGN PATENT DOCUMENTS

| | | | |
|---|---|---|---|
| 92403 | 3/1896 | Fed. Rep. of Germany | 493/444 |
| 1934420 | 2/1973 | Fed. Rep. of Germany | 493/444 |
| 480680 | 5/1953 | Italy | 493/444 |
| 58-127050 | 8/1983 | Japan . | |
| 61-176152 | 11/1986 | Japan . | |
| 62-17673 | 2/1987 | Japan . | |
| 62-136478 | 6/1987 | Japan . | |
| 62-290680 | 12/1987 | Japan . | |
| 63-24169 | 2/1988 | Japan . | |
| 1-111663 | 7/1989 | Japan . | |

*Primary Examiner*—William E. Terrell
*Attorney, Agent, or Firm*—Armstrong & Kubovcik

[57] ABSTRACT

A chopper-folder for restraining movement of a paper sheet relative to a folding slot as the sheet is conveyed along a path in a rotary printing press. The chopper-folder includes stoppers for stopping the movement of the paper sheet, restraining members for restraining vertical movement of the side edge portions of the paper sheet during the chopper-fold operation, and a driving unit for supporting and simultaneously driving the restraining members and the stoppers to conduct the chopper-fold operation. The stoppers, restraining members and the driving unit are mounted to the chopper-folder in such a manner that they can be easily moved away from the folding slot when jamming occurs during the chopper-fold operation, to facilitate quick and easy correction of the problem.

4 Claims, 2 Drawing Sheets

APPARATUS FOR RESTRAINING A PAPER WEB TO BE SUBJECTED TO CHOPPER-FOLD IN ROTARY PRINTING PRESS

BACKGROUND OF THE INVENTION

1. Field of the Invention

This invention relates to a chopper-folding mechanism for use in a rotary printing press, and more particularly to an apparatus for restraining the movement of a paper sheet during conveyance thereof along a paper sheet conveying path so as to apply a chopper-fold to the paper sheet.

2. Description of the prior art

A number of apparatuses for preventing both edges of a paper sheet from rising suddenly when it is subjected to a chopper-fold in a rotary printing press have heretofore been developed. These conventional apparatuses are disclosed, for example, in Japanese Laid-Open Utility Model Applications Nos. SHO58-127050, SHO 61-176152, SHO 62-17673, SHO 63-24169 and HEI 1-11163, and Japanese Laid-Open Patent Applications Nos. SHO 62-136478 and SHO 62-290680.

Out of these conventional apparatuses, those disclosed in the Japanese Laid-Open Utility Model Applications Nos. SHO 58-127050, SHO 61-176152 and SHO 63-24169 are constructed such that paper sheet guide members each having a suitable shape for restraining the movement of a paper sheet to be subjected to a chopper-fold are fixedly secured to a frame or the like above a paper sheet conveying path and adjacent to a folding slot (which is referred to as "first construction" hereinafter).

While, other conventional apparatuses disclosed in the Japanese Laid-Open Utility Model Application No. HEI 1-111663 and the Japanese Laid-Open Patent Applications Nos. SHO 62-136478 and SHO 62-290680 are each constructed such that a brush is mounted adjacent to a folding-slot so that the lower end thereof may slidably contact the upper surface of a paper sheet to be folded, and a stopper for stopping the movement of the paper sheet is mounted separately from the brush and in the paper sheet conveying path, each of the brush and the stopper having an independent shifting or displacement mechanism for changing their positions(which is referred to as "second construction" hereinafter).

Further, a further conventional apparatus disclosed in the Japanese Laid-Open Utility Model Application No. SHO 62-17673 is constructed such that a pair of endless belts are provided adjacent to a folding-slot formed in a paper sheet guide plate, and adapted to be driven by a driver means so as to run rotatably in a paper sheet conveying direction (which is referred to as "third construction" hereinafter).

Whereas, the above-mentioned prior art constructions have respective problems to be solved which will be mentioned below.

In the first construction, since the paper sheet guide members are fixedly secured to the frame, if during folding of the paper web underneath of the guide members or the folding-slot is jammed with a paper sheet, then the guide members hinder removal of the jammed paper sheet therefrom to put the apparatus into normal working condition. It is therefore necessary to detach and attach the paper sheet guide members before and after the restoring operation, thus lowering the operational efficiency.

Whilst, in the second construction, since the brush and the stopper have independent displacement or shifting mechanisms for changing their positions, if and when the above-mentioned jamming with a paper sheet occurs, then the brush and the stopper can be retracted quickly from their operating positions for the chopper-folding to their inoperative positions which do not interfere with the restoring operation, so that the restoring operation can be commenced immediately. However, the displacement mechanism of the brush and the stopper are each comprised of a lot of parts and relatively complex in structure so that manufacturing cost and maintenance cost thereof are both expensive. In addition, in case a change-over is made from a non-chopper-folding condition to a chopper-folding condition or vice versa, both the brush and the stopper have to be shifted separately. Therefore, failure of either one of the brush and stopper shifting operations results in an improperly folded paper sheet which has to be disposed of as waste.

Further, in the third structure, since the endless belts have flexibility and resilience, if jamming with a paper sheet occurs, restoring operation can be carried out while putting the belts aside along the paper sheet conveying path. However, since provision of a belt stretching mechanism and a belt driving mechanism in a relatively narrow space is required, difficulties are encountered when effecting assembly and maintenance thereof, and also manufacturing costs thereof are comparatively expensive.

SUMMARY OF THE INVENTION

The present invention has been made in view of the above-mentioned circumstances in the prior art, and has for its object to provide an apparatus for regulating a paper sheet to be subjected to a chopper-fold in a rotary printing press which enables restoring operation to be conducted quickly and easily when a trouble such as, for example, jamming with a paper sheet occurs during the chopper-folding operation, and which has a simple construction that renders it possible to carry out the restoring operation quickly and easily.

In order to achieve the above-mentioned object, according to an aspect of the present invention, there is provided an apparatus for restraining a paper sheet to be subjected to a chopper-fold by a chopper-folding mechanism of a rotary printing press which includes a guide plate arranged in a paper web conveying path and having an elongated chopper-folding slot formed therein along a paper sheet conveying direction, a chopper blade arranged above the guide plate such that it may be moved substantially in the vertical direction, and at least a pair of rotating rollers arranged under the guide plate, characterized in that it comprises: restraining means for restraining vertical movements of both side edges of the paper sheet during the chopper-folding operation, the restraining means being arranged to be located above the guide plate and also movable in close to the longitudinal side edges of the folding slot for purposes of chopper-folding operation; stopper means for stopping the movement of the paper sheet conveyed along the paper web conveying path, the stopper means being arranged in the vicinity of the downstream ends of the restraining means relative to the paper sheet conveying direction; and driver means for supporting the restraining means and the stopper means and driving these means simultaneously to conduct the chopper-folding operation.

In the above-mentioned construction, when chopper-folding of paper sheet is conducted, the driver means is rendered operative to change over the restraining means and the stopper means to their chopper-folding conditions. By this change-over, the restraining means are disposed adjacent to both sides of the longitudinally extending folding slot formed above the paper sheet conveying path, and the stopper means are advanced into the paper sheet conveying path in the vicinity of the downstream ends of the restraining means in the paper sheet conveying path, thereby blocking the path.

In such a chopper-folding condition, the rotary printing press is actuated. Upon actuation of the printing press, a paper sheet is supplied from a paper web supply section and printed at a printing section, and then sent to a folding section where it is cut and folded, and then conveyed on a paper sheet conveying path to a chopper-folding mechanism. The paper sheet which has reached the chopper-folding mechanism is advanced under the restraining means and stopped when the leading edge thereof strikes against the stopper means. Nearly in synchronism with the stopping of the paper sheet, the chopper blade is swung down with the result that the paper sheet is pushed down by the chopper blade substantially along the centre line thereof into the folding slot formed in the guide plate. The paper web is then further pushed down by the chopper blade in between the pair of rotating rollers. The paper sheet which has been pushed in between the pair of rotating rollers is delivered down-wards with the rotation of the rollers while it is being folded securely. Upon downward delivery of the paper sheet by the pair of rotating rollers, there is a tendency of both edges of the paper sheet rising suddenly before it is pushed down into the folding slot, but this sudden rising of the edges can be restrained by the restrainig means.

Upon completion of pushing the paper sheet down in between the pair of rotating rollers, the chopper blade is swung up to its original position.

In case the underneath of the restraining means or the folding slot is jammed with a paper sheet during chopper-folding operation, or when change-over is made from chopper-folding condition to non-chopper-folding condition or vice versa, the driver means is actuated reversely to that in the above-mentioned case to change the restraining means and the stopper means over to their respective non-chopper-folding conditions. By this changeover, the restraining means are moved away from their positions adjacent to the paper sheet conveying path, and the stopper means are retracted from the paper sheet conveying path, thereby opening the path.

According to the apparatus of the present invention, change-over from a chopper-fold operating condition to a non-chopper-fold condition or vice versa can be conducted by a single shifting operation.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENT

The present invention will now be described in detail below with reference to the accompanying drawings.

Figure 2:
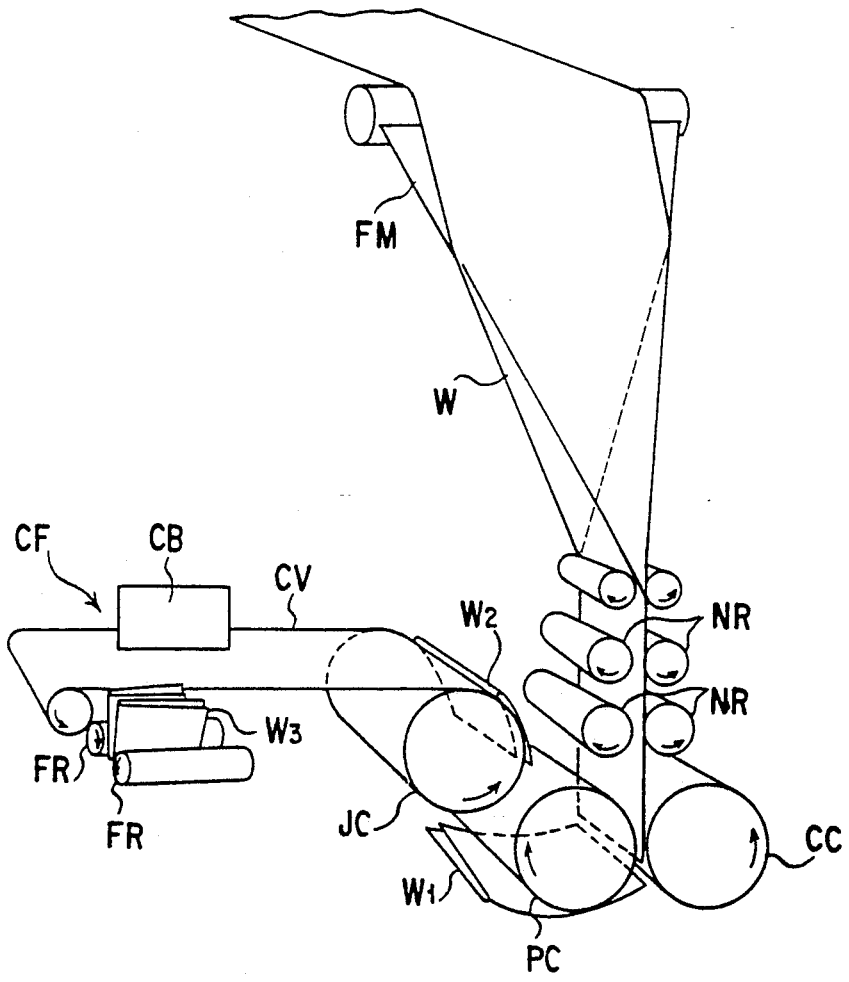
FIG. 2 is a schematic configurational view showing a folder section of a rotary printing press.

First of all, folding operation of a paper sheet W will be explained with reference to FIG. 2 showing a schematic view of a folder section of a rotary printing press.

The paper web W which has passed through a printing section (not shown) of the rotary printing press and reached a folder section is passed through a former plate (FM) and subjected to a former fold, i.e., the paper web W is folded along its longitudinal center line. After that, the paper web W is passed between nipping rollers NR and sent in between a cutting cylinder CC and a pin cylinder PC, and then allowed to run along the outer periphery of the pin cylinder PC as the latter rotates, with the leading edge of the paper web W held by a pin (not shown), while the paper web W is cut by a saw blade (not shown) of the cutting cylinder CC into a twice-folded paper sheet $W_1$. Subsequently, the paper sheet $W_1$ is passed from the pin cylinder PC to a jaw cylinder JC with the paper web $W_1$ being inserted along its center line parallel with the cut side edges thereof by a tucker blade (not shown) of the pin cylinder PC into a holder portion (not shown) of the jaw cylinder, and then the paper sheet $W_1$ is further twice folded about the above-mentioned center line, resulting in a paper sheet $W_2$. The paper web $W_2$ is then conveyed with rotation of the jaw cylinder JC to a conveyor means CV forming the conveying path leading to a chopper-folder mechanism CF. When the paper sheet $W_2$ has been moved by the conveyor means CV to a position under a chopper blade CB, the chopper blade CB is swung down towards the center line of the paper sheet $W_2$ so that the latter is subjected to a chopper-fold, thereby forming a chopper-folded paper sheet $W_3$, which is passed through a folding slot 2 formed in the conveying path, and a pair of rotating rollers FR, FR to the next conveyor means.

Figure 1:
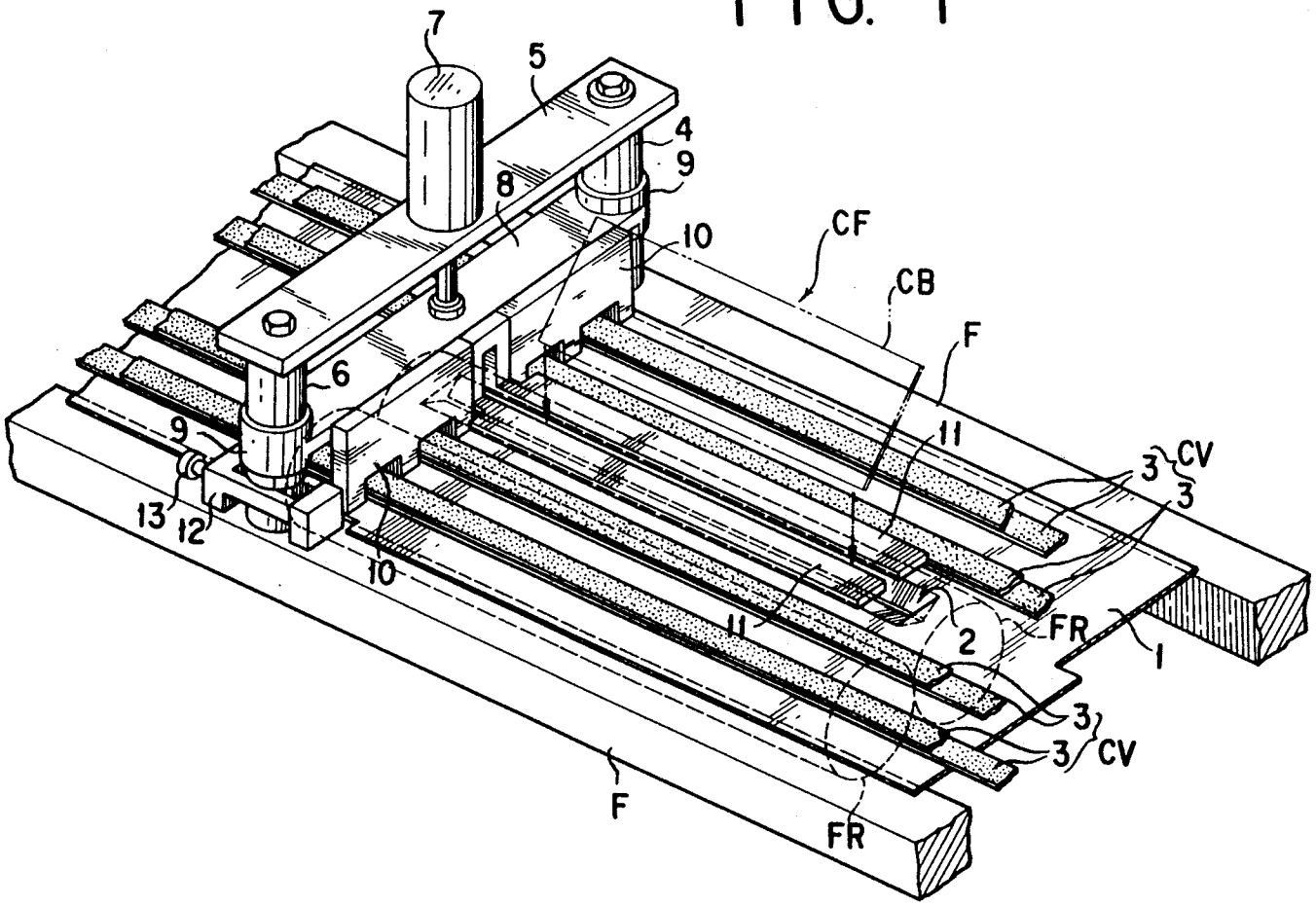
FIG. 1 is a schematic, perspective view showing one embodiment of the present invention.

The present invention relates to a chopper-folder mechanism CF in the above-mentioned folder section, and FIG. 1 shows the schematic construction of one embodiment thereof.

A guide plate 1 is attached to frames F, F and has a folding slot 2 formed substantially along the longitudinal center line. Further, a chopper blade CB is supported above the folding slot 2 and in alignment therewith in such a manner that it may be swung up and down by means of a supporting means, not shown, substantially in the vertical direction. And, arranged below the folding slot 2 and in alignment therewith is a pair of rotating rollers FR, FR provided with a rotating driver mechanism, not shown. Provided on the upper surface of the guide plate 1 is a conveyor means CV forming a conveying path for the paper sheet $W_2$ passed from the jaw cylinder JC. In the embodiment shown in the drawings, the conveyor means CV is constituted by four pairs of endless belts 3, 3 (shown only partly) adapted to be moved by a driver means, not shown, in parallel with the folding slot 2.

One of the frames F has a guide support 4 whose lower end is fixedly secured thereto at a position near one end side of the folding slot 2. A first connecting member 5 is mounted at one side thereof on the upper end of the guide support 4 in such a manner that it can be turned freely about the axis of the guide support 4. Fixedly secured to the other side of the first connecting member 5 is the upper end of a guide rod 6 whose lower end is abutted against the upper surface of the other frame F. Thus, the guide rod 6 is suspended in parallel with the guide support 4. Further, fixedly secured to an approximately central part of the first connecting member 5 is a hydraulic cylinder 7, which serves as a driver means, and whose extensible and retractible rod is directed downwards.

A second connecting member 8 is fixedly secured to the leading end of the extensible and retractible rod of the hydraulic cylinder 7. The second connecting member 8 is fitted with sliding members 9, 9 on both sides thereof. One of the sliding members 9, 9 is fitted over the guide support 4 slidably therealong and rotatably thereto, whilst the other guide member 9 is fitted over the guide rod 6 slidably therealong and rotatable thereto. Further, the second connecting member 8 is attached at the lower portion thereof with stoppers 10, 10 whose lower end surfaces are brought into contact with the upper surface of the guide plate 1 when the extensible and retractible rod of the hydraulic cylinder 7 is extended. Each of these stoppers 10, 10 has a plurality of notches formed in the lower end portion thereof at positions aligned with those of two pairs of endless belts 3, 3. Further, the second connecting member 8 is attached at its lower side thereof with restraining members 11, 11 which extend in parallel with the folding slot 2 and whose length is slightly longer than the length of the paper sheet $W_2$ in the paper web conveying direction. The arrangement is made such that when the extensible and retractible rod of the hydraulic cylinder 7 is extended the restraining members 11, 11 can reach their operating positions which are near both sides of the folding slot 2 and above the paper sheet conveying path.

Still further, the guide rod 6 has a reduced diameter portion formed thereon so as to extend downwards from a position slightly lower than the longitudinal central portion thereof. This reduced diameter portion is inserted through a guide member 12 whose lower ends are fixedly secured onto one of the frames F. An adjusting screw 13 is threadably engaged with one side of the guide member 12 so that the leading end of the screw 13 is abutted against one side of the reduced diameter portion of the guide rod 6. Further, the other side of the guide member 12 in opposed relationship with the adjusting screw 13 is provided with a biasing member such as for example a spring, not shown, which is abutted against the other side of the reduced diameter portion of the guide rod 6 for biasing the latter towards the adjusting screw 13.

According to the above-mentioned arrangement, when chopper-folding operation is conducted, prior to operation of the rotary printing press, a valve, not shown is manipulated to extend the extensible and retractible rod in the hydraulic cylinder 7 to thereby lower the second connecting member 8 along the guide support 4 and the guide rod 6, and the second connecting member 8 is stopped when the lower ends of the stoppers 10, 10 are abutted against the upper surface of the guide plate 1, thereby blocking the conveying path of the paper sheet $W_2$. The restraining members 11, 11 are attached to the second connecting member 8 with a proper distance preset and kept between the lower surfaces of the restraining members 11, 11 and the lower ends of the stoppers 10, 10. The restraining members 11, 11 are arranged to be displaced with displacement of the stoppers 10, 10 and stopped at a position where their lower surfaces can effectively restrain sudden rising of the paper sheet $W_2$ to be chopper-folded.

When the rotary printing press is actuated in this condition, as mentioned hereinbefore, the paper sheet $W_2$ which has reached the jaw cylinder JC is passed from the latter in between four upper endless 3, belts respectively, and four lower endless belts 3, respectively of the conveyor means CV, and caught in between them, and then sent to a position above the folding slot 2.

Subsequently, when the leading edge of the paper sheet $W_2$ which has been conveyed to the position above the slot 2 is brought into contact with the stoppers 10, 10, the chopper blade CB is swung down towards the centre line of the paper sheet $W_2$ which is parallel with the conveying direction, thereby pushing down the central portion of the paper sheet $W_2$ into the folding slot 2, and then pushing it down in between the pair of rotating rollers FR, FR.

When the paper sheet $W_2$ has been pushed down in between the rotating rollers FR, FR, the chopper blade CB is swung up and ready for a subsequent paper sheet $W_2$ to be conveyed by the conveyor means in the same manner as mentioned above.

Further, if the leading edges of the paper sheet $W_2$ does not strike against the stoppers 10, 10, correctly, then a fold line created by the chopper-folding does not meet the leading edge of the paper sheet $W_2$ in line contact, thus producing an improperly folded paper sheet. Accordingly, when the leading edge of the paper sheet $W_2$ does not strike against the stoppers 10, 10 correctly, the adjusting screw 13 is manipulated to displace the guide rod 6 along the guide member 12 backward and forward in the paper sheet conveying direction, thereby making adjustment so as to enable the leading edge of the paper sheet $W_2$ to strike against the stoppers 10, 10 correctly or in line contact therewith.

The paper sheet $W_2$ which has been pushed down in between the pair of rotating rollers FR, FR is further sent down by the rotation of the rollers FR, FR. At that time, both side edges of the paper sheet $W_2$ which has passed through and between the endless belts 3, 3 located near the folding slot 2 and has become free tend to rise suddenly, but the upward movement of the paper sheet $W_2$ is restrained by the lower surfaces of the restraining members 11, 11.

When jamming with a paper sheet occurs during a chopper-folding operation or when chopper-folding operation is not conducted, the valve, not shown, is reversely operated to retract the extensible and retractible rod in the hyraulic cylinder 7 to thereby pull up the second connecting member 8 to a position near the first connecting member 5, thus raising the lower ends of the stoppers 10, 10 sufficiently away from the guide plate 1 to open the paper sheet conveying path, and also raising the restraining members 11, 11 away from the guide plate 1. By so doing, it becomes possible for the operator to insert his hand between the restraining members 11, 11 and the guide plate 1 so that the jammed paper sheet can be removed quickly. Further, by rendering the rotary printing press operative in this condition, a paper sheet $W_2$ which is not folded by the chopper is sent out from the downstream side of the conveyor means CV.

Further, when chopper-folding operation is conducted, the operation of the chopper blade CB is suspended and the rotary printing press is rendered operative precedently. At a proper timing when the operating speed of the rotary printing press has increased more than a predetermined value, it is possible to commence the operation of the chopper blade CB, and also actuate the valve, not shown, to extend the extensible and retractible rod in the hydraulic cylinder 7 thereby lowering the stoppers 10, 10 and the restraining members 11, 11, as mentioned above. According to this procedure, improper delivery of the paper sheet $W_2$ which tends to occur between the pair of rotating rollers FR, FR at a low speed operation of the rotary printing press can be avoided.

The present invention is not to be limited to the above-mentioned embodiment, but changes and modifications thereof may be made without departing from the scope of the claims. For example, it is possible to attach the restraining members 11, 11 through a height adjusting mechanism, not shown, to the second connecting member 8 to enable the spacing between the restraining members 11, 11, which are being lowered, and the guide plate 1 to be adjusted depending on the thickness of the paper sheet $W_2$.

Since implementation of the present invention enables change-over from chopper-folding condition to non-chopper-folding condition or vice versa to be completed by one shifting or displacing operation in a chopper-folding mechanism capable of restraining paper sheets to be folded by a chopper, when a trouble such as jamming with a paper sheet occurs during the chopper-folding operation, restoring operation can be made quickly and easily. Further, upon resumption of chopper-folding, change-over to chopper-folding condition can be made quickly.

Further, since the construction of the apparatus is simplified, assembly and maintenance thereof can be made very easily, and the costs thereof can be reduced significantly.

It is to be understood that the foregoing description is merely illustrative of a preferred embodiment of the invention, and that the scope of the invention is not to be limited thereto, but is to be determined by the scope of the appended claims.

What is claimed is:

1. An apparatus for restraining a paper sheet to be subjected to a chopper-fold by a chopper folding mechanism of a rotary printing press which includes a substantially horizontally arranged guide plate disposed in a paper sheet conveying path and having a elongated chopper-folding slot formed therein along a paper sheet conveying direction, a chopper blade arranged above the guide plate such that the chopper blade may be moved substantially in the vertical direction into and out of the chopper-folding slot, and at least a pair of rotating rollers arranged under the guide plate and adapted to receive a paper sheet folded by the chopper blade, said apparatus comprising:

conveyor means comprising a plurality of conveyor belts movable above the guide plate in a direction of sheet travel, each such conveyor belt being of lesser width than the guide plate;

vertically movable support means located above the guide plate;

restraining means for restraining vertical movements of side edge portions of the paper sheet during the chopper-folding operation, said restraining means being in the form of elongated bars each of which is connected at one end thereof to the support means, said restraining means being spaced closely to and above longitudinal side edges of the folding slot during the chopper-folding operation and retractable away from the guide plate with the support means when the chopper folder is not in operation;

stopper means for stopping movement of a paper sheet conveyed along the paper sheet conveying path on the conveyor means, said stopper means being mounted on the support means beyond the downstream end of the restraining means relative to the paper sheet conveying direction and vertically movable with the support means in coordination with movement of the restraining means, said stopper means comprising notches for passage therethrough of the conveyor means during conduct of the chopper-folding operation; and driver means for simultaneously retracting and extending the support means, the restraining means, and the stopper means.

2. An apparatus for restraining a paper sheet to be subjected to a chopper-fold by a chopper folding mechanism of a rotary printing press which includes a guide plate arranged in a paper sheet conveying path and having an elongated chopper-folding slot formed therein along a paper sheet conveying direction, a chopper blade arranged above the guide plate such that it may be moved substantially in the vertical direction, and at least a pair of rotating rollers arranged under the guide plate and adapted to receive a paper sheet folded by the chopper blade, said apparatus comprising:

a guide support having a lower end secured to one of a pair of frames arranged at both sides of the paper sheet conveying path, respectively, and extending in parallel with each other along the paper sheet conveying path;

a first connecting member mounted at one side thereof on the upper end of said guide support and rotatable about a vertical axis of said guide support;

a guide rod fixedly secured at its upper end to the other side of said first connecting member and extending downwards in parallel with said guide support so as to abut at its lower end against an upper surface of the other frame;

a hydraulic cylinder fixedly secured to an approximately central portion of said first connecting member and having an extensible and retractable rod directed downward;

a second connecting member secured at a position intermediate two ends of the second connecting member to a leading end of the extensible and retractable rod of said hydraulic cylinder;

sliding members integrally connected to each end of said second connecting member and fitted over said guide support and said guide rod, respectively, so as to be slidable vertically therealong and rotatable with respect thereto;

stoppers attached at the lower end of said second connecting member, respective lower end surfaces of said stoppers being brought into contact with an upper surface of said guide plate when the extensible and retractable rod of said hydraulic cylinder is extended, each of said stoppers having a plurality of notches formed in a lower end portion thereof so as to allow pairs of endless belts forming said paper sheet conveying path to pass therethrough; and restraining members fixedly attached to inward lower sides of said second connecting member, respectively, and extending in parallel with said chopper-folding slot along both sides thereof, the arrangement of said restraining members being made such that when the extensible and retractable rod of said hydraulic cylinder is extended, said restraining members are positioned in respective operating positions near both sides of said chopper-folding slot and above the paper sheet conveying path so as to restrain the vertical movement of both ends of the paper sheet during the chopper-folding operation.

3. An apparatus for restraining a paper sheet to be subjected to a chopper-fold by a chopper folding mechanism as set forth in claim 2, wherein each of said restraining members has a longitudinal length slightly longer than the length of a paper sheet in its conveying direction.

4. An apparatus for restraining a paper sheet to be subjected to a chopper-fold by a chopper folding mechanism as set forth in claim 2, wherein said guide rod has a reduced diameter portion formed thereon so as to extend downwards from a position slightly lower than the longitudinal central portion thereof and inserted through a guide member whose lower end is fixedly secured onto said other frame so as to be subjected to a position shift thereof by means of an adjusting screw threadably engaged with one side of the guide member and abutted at its leading end against one side of the reduced diameter portion and also by means of a biasing member abutted against the other side of the reduced diameter portion for biasing the latter towards the adjusting screw.

* * * * *